US012398601B2

(12) United States Patent
Shukla et al.

(10) Patent No.: US 12,398,601 B2
(45) Date of Patent: Aug. 26, 2025

(54) SELF INDEXING MULE SHOE MECHANISM

(71) Applicant: Schlumberger Technology Corporation, Sugar Land, TX (US)

(72) Inventors: Pranav Shukla, Pune (IN); Farshad Odakkal, Rosharon, TX (US); Jai Singh, Pune (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/640,915

(22) Filed: Apr. 19, 2024

(65) Prior Publication Data

US 2024/0392634 A1 Nov. 28, 2024

(30) Foreign Application Priority Data

Apr. 20, 2023 (IN) ..... 202311028771

(51) Int. Cl.
*E21B 17/14* (2006.01)

(52) U.S. Cl.
CPC ..... *E21B 17/14* (2013.01)

(58) Field of Classification Search
CPC ..... E21B 17/14; E21B 23/004; E21B 23/006
See application file for complete search history.

(56) References Cited

U.S. PATENT DOCUMENTS

| | | | | |
|---|---|---|---|---|
| 4,321,965 | A * | 3/1982 | Restarick | E21B 31/14 166/240 |
| 7,513,302 | B2 | 4/2009 | Cassidy | |
| 11,203,902 | B2 | 12/2021 | Mackay | |
| 2007/0125577 | A1* | 6/2007 | Brunet | E21B 7/061 166/313 |
| 2011/0139510 | A1 | 6/2011 | Declute-Melancon | |
| 2011/0147006 | A1* | 6/2011 | O'Malley | E21B 43/12 166/330 |
| 2012/0118641 | A1* | 5/2012 | Sheehan | F16F 1/121 175/57 |
| 2015/0047840 | A1* | 2/2015 | Hurtado | E21B 7/061 166/255.2 |
| 2021/0355811 | A1 | 11/2021 | Patterson | |

* cited by examiner

*Primary Examiner* — David Carroll

(57) ABSTRACT

A system and method for providing a rotating a mule shoe assembly. The mule shoe assembly is disclosed with a top sub adapted to be connected to a tool string. A spring retainer for retaining a wave spring in a chamber created by the top sub and spring retainer. A mule shoe adjacent the spring retainer that linearly translate and rotate when a force is applied. The spring retainer has one or more pins that engages one or more linear slots in the top sub. A key moves in an indexing slot causing the mule shoe to linearly translate and rotate. The indexing slot is machined in the outer diameter of the top sub. During the stroke of the mule shoe, the one or more pins move in the linear slots and the key moves in the indexing slot.

11 Claims, 2 Drawing Sheets

SELF INDEXING MULE SHOE MECHANISM

CROSS-REFERENCE TO RELATED APPLICATION

The present document is based on and claims priority to India Provisional Application Serial No.: 202311028771, filed Apr. 20, 2023, which is incorporated herein by reference in its entirety.

BACKGROUND

This invention relates to mule shoe mechanisms in generally well operations. More particularly, the invention relates to a method and apparatus for using a rotating mule shoe.

Downhole tools often need a mule shoe at the lower end of a tool string. The mule shoe is typically connected to the leading end of the tool string to guide the tool string in a wellbore. The mule shoe has a nose which is shaped, typically tapered, to push aside deposits and debris and fluids as it is run down hole into the wellbore. Prior art mule shoes may have a standard compression helical spring. In order to prevent the mule shoe from being stuck or provide proper orientation, the tool string would have to be rotated. The rotation of the tool string would cause the standard compression spring to distort and twist compromising the effectiveness of the spring. The prior art does not have a mechanism which prevents the rotation of a spring due to twisting moment.

What is needed is a way to prevent the rotation of the spring due to twisting. The current invention uses a wave spring and a rotatable mule shoe in the mule shoe assembly to solve this issue.

SUMMARY

The current invention is a self indexing mule shoe assembly. The mule shoe assembly is adapted for connection to an end of a tool string comprising a top sub adapted for connection to the end of the tool string. A spring retainer for retaining a wave spring in a chamber created by the top sub and spring retainer. A mule shoe adjacent the spring retainer that linearly translate and rotate when a force is applied. The spring retainer has one or more pins that engages one or more linear slots in the top sub that allows the spring retainer to linearly move. The top sub has a first end with a threaded section adapted to connect to end of a tool string and a second end of the top sub is connected to the mule shoe, wherein the second end is not threaded. The mule shoe linearly translates and rotates by a key on the mule shoe that engages with an indexing slot. The indexing slot and the key allows for a full 360 degree rotation. The key connects the top sub to the mule shoe. The wave spring is positioned between an upper stop created by the top sub and a lower stop created by the spring retainer.

A method of deploying a tubular in a wellbore comprising connecting a mule shoe assembly to an end of a tool string. Running the tool string and mule shoe assembly into the well. Actuating the mule shoe assembly by stroking a mule shoe by rotating and linearly moving a mule shoe relative to a top sub when a compression force or tension force is applied. Rotating and linearly moving the mule shoe comprises applying a compression force or tension force to the mule shoe to move a key on the mule shoe along a path created by an indexing slot machined on the top sub. The compression force created is by an obstruction in the wellbore or the tension force is created by a wave spring, the compression force created by the obstruction compresses the wave spring and the tension force expands the wave spring. Each stroke of the mule shoe causes the mule shoe to move linearly and rotate.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The figures are not necessarily to scale, and certain features and certain view of the figures may be shown exaggerated in scale or in schematic in the interest of clarity and conciseness.

DETAILED DESCRIPTION

Figure 1:
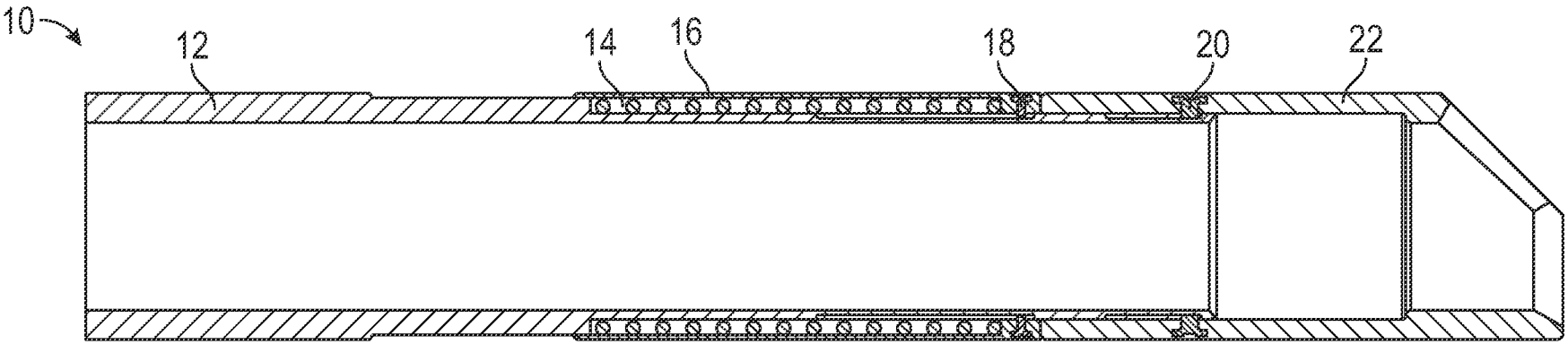
FIG. 1 is a cross-sectional diagram of an indexing mule shoe assembly in an uncompressed position.

The invention will now be described in detail with reference to a few preferred embodiments, as illustrated in the accompanying drawings. In describing the preferred embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

FIG. 1 illustrates an indexing mule shoe assembly 10 in which the apparatus and method of the invention may be employed. The mule shoe assembly 10 includes an elongated top sub 12 and a spring retainer 16 located external and adjacent to the top sub 12. A chamber is created between the top sub 12 and spring retainer 16. Within the chamber is a wave spring 14. The wave spring 14 may act as a shock absorber as the mule shoe assembly 10 descends in a wellbore. Additionally, the wave spring 14 assists with orientation of the mule shoe 22. The wave spring 14 allows the mule shoe 22 to rotate and translate linearly. The mule shoe assembly may be used with a completions string to ensure an unrestricted and smooth guided entry into a polished bore receptacle or lateral wellbore. Additionally, there are no internal threaded connection between the top sub 12, spring retainer 16 and mule shoe 22.

Figure 3:
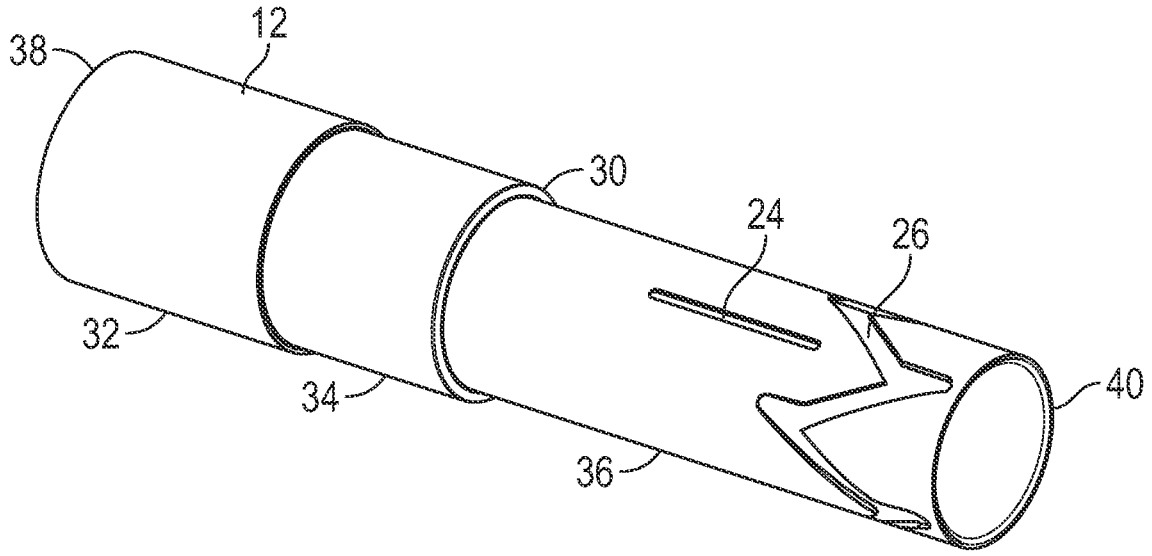
FIG. 3 is an orthogonal side view of a top sub of the indexing mule shoe assembly illustrating an indexing slot and linear slot.

The top sub 12 has a first end 38 and second end 40 as illustrated in FIG. 3. The top sub 12 is generally cylindrically-shaped with a bore. The top sub 12 is tubular shaped and has three section with three different circular cross-section diameters. The three different circular cross-section diameters of top sub 12 creates two shoulders. A first section 32 incorporates the first end 38. The first section 32 is the largest of the three sections. The second section 34 is between the first section 32 and third section 36 of the top sub 12. The first end 38 has a thread section (not shown) which is adapted to connect to a threaded lower end of a tool string or another tool. The first end 38 of the top sub 12 may be connected to a downhole tool above the top sub 12 such as a completion or measuring tool. The second end is not threaded and is adapted to be connected to the mule shoe 22.

Connected to the lower end of the top sub is the mule shoe 22. The mule shoe 22 is rotatable. The mule shoe has a nose mounted at the lower end of the mule shoe. The mule shoe 22 may have a tapered nose section. The taper extends from a wall of the mule shoe 22 to lower end of the mule shoe 22. The nose is adapted to facilitate entry into a tubular in a lateral wellbore or a polished bore receptacle. Additionally, the tapered nose section is adapted to rotate when the tapered nose section is not aligned for entry into a lateral wellbore or a polished bore receptacle. The tapered nose section is adapted to breakup debris.

Figure 2:
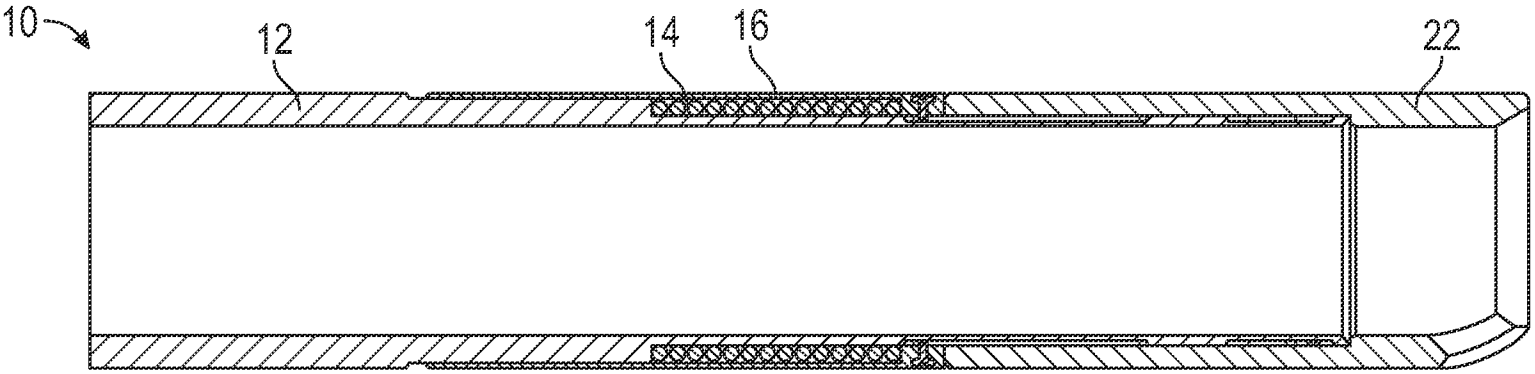
FIG. 2 is a cross-sectional diagram of indexing mule shoe assembly in a compressed position.

FIG. 2 illustrates the indexing mule shoe assembly 10 in a compressed position. The mule shoe 22 is compressed relative to the top sub 12. The mule shoe acts as a piston causing spring retainer 16 to travel towards the top end 38 of the top sub 12 compressing the wave spring 14. In the compressed position the mule shoe 22 has traveled linearly and has indexed causing the mule shoe 22 to rotate. Furthermore, the spring retainer 16 also travels towards the top end 38 of the top sub 12 compressing the wave spring 14. The mule shoe 22 can be compressed and uncompressed many times cycling the mule shoe 22. The wave spring 14 assisted with uncompressing the mule shoe 22 and rotating the mule shoe 22. The tool string does not have to be rotated to orient the mule shoe 22 since the indexing mule shoe assembly 10 is able to rotate without the assistance of the tool string.

FIG. 3 illustrates a linear slot 24 in the third section 36 of the top sub 12. The spring retainer 16 has a pin 18 that engages the linear slot 24. There may be more than one linear slot 24 in the third section 36 and corresponding pins 18 in the spring retainer. The linear slot 24 and pin 18 guide the spring retainer 16 as the spring retainer moves linearly between a first and second position. The one or more pins 18 eliminate the twisting moment being transferred on to the wave spring 14, thus preventing the damage of the wave spring 14. The linear slot 24 determines the distance the spring retainer 16 travels between an uncompressed and compressed position of the mule shoe assembly 10. The top sub 12 has an indexing slot 26 cut in the outer surface of the top sub 12. The indexing slot 26 is a guide for the rotation of the mule shoe 22. A key 20 moves in the indexing slot 26 causing the mule shoe 22 to rotate. The key 20 connects the top sub to the mule shoe. The key 20 prevents the mule shoe 22 from falling into the wellbore. The indexing slot 26 is machined in the outer diameter of the top sub 12 so that the mule shoe 22 rotates as the mule shoe 22 moves linearly. The mule shoe 22 only rotates when the mule shoe assembly 10 is stroked switches from an uncompressed position to a compressed position and vice versa.

Figure 4:
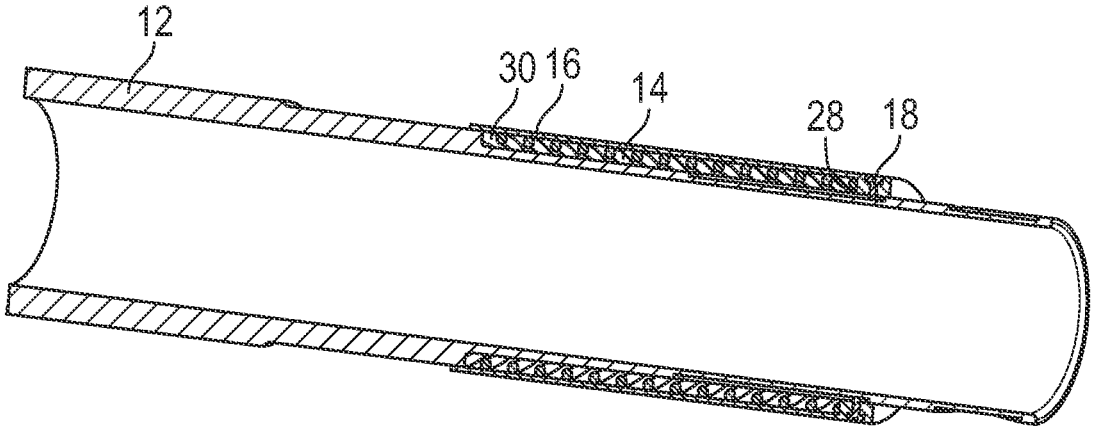
FIG. 4 is a cross-sectional diagram of the top sup, spring, spring retainer and screw of the indexing mule shoe assembly.

FIG. 4 illustrates the top sub 12, wave spring 14, spring retainer 16 and the key 20. The wave spring is positioned between an upper stop 30 created by the top sub 12 and a lower stop 28 created by the spring retainer 16. The spring retainer 16 travels linearly towards the top section 32 of the top sub 12 compressing the wave spring 14. The pin 18 prevents the spring retainer 16 from falling into the wellbore.

In operation, the mule shoe 22 makes the first contact with an obstruction in a wellbore causing the mule shoe 22 to translate and compressing the wave spring 14. The compressive force generated rotates the mule shoe 22 and the key 20 is guided along indexing slot 26 machined on the top sub 12. The indexing slot 26 is machined in the outer diameter of the top sub so that the mule shoe 22 moves linearly as the mule shoe 22 rotates.

The one or more pins 18 engaged in the one or more linear slots 24 prevent the twisting moment of the mule shoe 22 being transferred to the wave spring 14 and spring retainer 16, thus preventing the damage of the wave spring 14. During the stroke of the mule shoe 22, the pins 18 have a linear movement along the linear slots 24 machined on the top sub 12.

In the fully compressed position, the mule shoe 22 bottoms out on the top sub 12 thus transferring the compressive load from the mule shoe 22 to the wave spring 14. Once the mule shoe assembly 10 has bypass the obstruction or removed the compressive force, the compression load is transferred back to the mule shoe 22 by the wave spring 14. The angle of rotation in the current design is 42 degree however the angle of rotation can be adjusted. The appropriate angle of rotation ensures that the wave spring does not reaches the wave spring's solid length and eliminates the damage on the wave spring. The wave spring expands when the tool string is pulled up and the mule shoe rotates further by 48 degree. The current design of the assembly provides a full 360 degree rotation of the mule shoe.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A mule shoe assembly adapted for connection to an end of a tool string comprising:

a top sub adapted for connection to the end of the tool string;

a spring retainer for retaining a wave spring in a chamber created by the top sub and the spring retainer;

the spring retainer has one or more pins that engages one or more linear slots in the top sub that allows the spring retainer to linearly move;

the wave spring is positioned between an upper stop created by the top sub and a lower stop created by the spring retainer; and a mule shoe adjacent the spring retainer that linearly translate and rotate when a force is applied by contacting an obstruction in a wellbore.

2. The mule shoe assembly of claim 1, wherein the top sub has a first end with a threaded section adapted to connect to end of a tool string and a second end of the top sub is connected to the mule shoe, wherein the second end is not threaded.

3. The mule shoe assembly of claim 1, wherein the mule shoe linearly translates and rotates by a key on the mule shoe that engages with an indexing slot.

4. The mule shoe assembly of claim 3, wherein the indexing slot and the key allows for a full 360 degree rotation.

5. The mule shoe assembly of claim 3, wherein the key connects the top sub to the mule shoe.

6. The mule shoe assembly of claim 1, wherein the wave spring is positioned between an upper stop created by the top sub and a lower stop created by the spring retainer.

7. The mule shoe assembly of claim 1, further comprising a downhole tool between the tool string and mule shoe assembly.

8. A method of deploying a tubular in a wellbore comprising:

connecting a mule shoe assembly to an end of a tool string;

running the tool string and mule shoe assembly into the well;

the mule shoe assembly comprises:

a top sub adapted for connection to the end of the tool string;

a spring retainer for retaining a wave spring in a chamber created by the top sub and the spring retainer;

wherein the spring retainer has one or more pins that engages one or more linear slots in the top sub that allows the spring retainer to linearly move;

a mule shoe adjacent the spring retainer that linearly translate and rotate when a force is applied; and actuating the mule shoe assembly by stroking the mule shoe by rotating and linearly moving the mule shoe relative to the top sub when a compression force is applied by an obstruction in the wellbore or tension force is applied by the wave spring once the obstruction is cleared.

9. The method of claim 8, wherein rotating and linearly moving the mule shoe comprises applying a compression force or tension force to the mule shoe to move a key on the mule shoe along a path created by an indexing slot machined on the top sub.

10. The method of claim 9, wherein the compression force created is by an obstruction in the wellbore or the tension force is created by a wave spring, the compression force created by the obstruction compresses the wave spring and the tension force expands the wave spring.

11. The method of claim 8, wherein each stroke of the mule shoe causes the mule shoe to move linearly and rotate.

* * * * *